US007036299B2

(12) United States Patent
Hietpas et al.

(10) Patent No.: US 7,036,299 B2
(45) Date of Patent: May 2, 2006

(54) STRETCH POLYSTER/COTTON SPUN YARN

(75) Inventors: Geoffrey D. Hietpas, Newark, DE (US); Steven W. Smith, Waynesboro, WV (US)

(73) Assignee: Invista North America S.a.r.l., Wilmington, DE (US)

( * ) Notice: Subject to any disclaimer, the term of this patent is extended or adjusted under 35 U.S.C. 154(b) by 246 days.

(21) Appl. No.: 10/323,302

(22) Filed: Dec. 19, 2002

(65) Prior Publication Data

US 2003/0159423 A1 Aug. 28, 2003

Related U.S. Application Data

(63) Continuation-in-part of application No. 10/286,683, filed on Nov. 1, 2002, now abandoned, which is a continuation-in-part of application No. 10/029,575, filed on Dec. 21, 2001, now abandoned.

(51) Int. Cl.
*D02G 3/04* (2006.01)

(52) U.S. Cl. ..... 57/256

(58) Field of Classification Search ..... 57/75, 57/252, 254–256, 327

See application file for complete search history.

(56) References Cited

U.S. PATENT DOCUMENTS

| | | | | |
|---|---|---|---|---|
| 3,454,460 | A | 7/1969 | Bosley | |
| 3,671,379 | A | 6/1972 | Evans et al. | |
| 3,914,488 | A | 10/1975 | Gorrafa | |
| 4,634,625 | A | 1/1987 | Franklin | |
| 4,991,387 | A * | 2/1991 | Tashiro et al. | 57/256 |
| 5,102,724 | A | 4/1992 | Okawahara et al. | |
| 5,219,506 | A | 6/1993 | Anderson et al. | |
| 5,626,961 | A | 5/1997 | Aneja | |
| 5,723,215 | A | 3/1998 | Hernandez et al. | |
| 5,736,243 | A | 4/1998 | Aneja | |
| 5,874,372 | A | 2/1999 | Morishita et al. | |
| 2003/0131578 | A1 * | 7/2003 | Hietpas et al. | 57/256 |

FOREIGN PATENT DOCUMENTS

| | | |
|---|---|---|
| EP | 0604973 | 7/1994 |
| JP | 62-085026 | 4/1987 |
| JP | 00328382 A | 11/2000 |
| JP | 2001288621 | 10/2001 |
| JP | 2002054029 | 2/2002 |
| WO | WO 0077283 A2 | 12/2000 |
| WO | WO-01/53573 | 7/2001 |
| WO | WO 0166837 A1 | 9/2001 |

OTHER PUBLICATIONS

Kathryn L Hatch, Textile Science, West Publishing Company, 1993, 1st edition, p. 90.*

Uster Statistics 2001, Statistics on the quality of carded PES/CO 65/35 and 67/33 ring–spun yarns determined with Uster® testing instruments for the textile laboratory, Zellweger Luwa AG, 16.1, 16.2, 16.3, 16.4, 16.5, 16.6, 16.7, 16.8, and 16.9.

Kathryn L. Hatch, Textile Science 1993, West Publishing Co., pp. 270–273.

* cited by examiner

*Primary Examiner*—John J. Calvert
*Assistant Examiner*—Shaun R. Hurley
(74) *Attorney, Agent, or Firm*—Robert B. Furr, Jr.

(57) ABSTRACT

A spun yarn of cotton (35 wt %–80 wt %) and a bicomponent staple fiber (20wt%–65wt%) of poly(ethylene terephthalate) and poly(trimethylene terephthalate) based on total weight of the spun yarn. The spun yarn has a total boil-off shrinkage of about 22%. The bicomponent staple fiber component has a tow crimp development value of about 35%–70%; a tow crimp index value of about 14%–45%; a length of about 1.3–5.5 cm; and a linear density of about 0.7–3.0 decitex per fiber. The difference between the crimp index and the crimp development values is about 24%–35% absolute.

7 Claims, 2 Drawing Sheets

STRETCH POLYSTER/COTTON SPUN YARN

CROSS REFERENCE(S) TO RELATED APPLICATION(S)

This application is a continuation-in-part of application Ser. No. 10/286,683 filed Nov. 1, 2002, now abandoned, which is a continuation-in-part of application Ser. No. 10/029,575 filed Dec. 21, 2001; now abandoned.

BACKGROUND OF THE INVENTION

1. Field of the Invention

This invention relates to spun yarn comprising polyester staple fiber and cotton, more particularly such a yarn in which the polyester staple is a bicomponent that imparts desirable properties to the yarn, and to polyester bicomponent staple fibers having selected properties, more particularly such fibers comprising poly(ethylene terephthalate) and poly(trimethylene terephthalate).

2. Discussion of Background Art

Polyester bicomponent fibers are known from U.S. Pat. Nos. 3,454,460 and 3,671,379, which disclose spun yarns made from bicomponent staple having certain ranges of crimp properties outside of which the yarns are said to be boardy, harsh, and aesthetically undesirable.

Spun yarns comprising bicomponent staple fibers are also disclosed in Japanese Published Patent Applications JP62-085026, and JP2000-328382 and in U.S. Pat. Nos. 5,723,215 and 5,874,372, but such fibers can have little recovery power and can require mechanical crimping which adds to their cost.

Polyester fibers having longitudinal grooves in their surfaces are described in U.S. Pat. Nos. 3,914,488, 4,634,625, 5,626,961, and 5,736,243, and Published International Patent Application WO01/66837, but such fibers typically lack good stretch and recovery properties.

Published International Application WO00-77283 discloses tows of polyester bicomponent fibers, but such tows are said to require 'de-registering' to be useful, an added cost.

Spun yarns of polyester bicomponent staple fibers and cotton that have high stretch and uniformity characteristics are still needed, as are polyester bicomponent staple fibers having both improved processability and stretch and recovery properties.

SUMMARY OF THE INVENTION

The present invention provides a spun yarn having a total boil-off shrinkage of at least about 22% and comprising cotton and a bicomponent staple fiber comprising poly (ethylene terephthalate) and poly(trimethylene terephthalate) wherein the bicomponent fiber has a tow crimp development value of about 35% to about 70%, a tow crimp index value of about 14% to about 45%, a length of about 1.3 cm to about 5.5 cm, a linear density of about 0.7 decitex per fiber to about 3.0 decitex per fiber, and wherein the bicomponent fiber is present at a level of about 20 wt % to about 65 wt %, based on total weight of the spun yarn and wherein the cotton is present at a level of about 35 wt % to about 80 wt %, based on total weight of the spun yarn.

The invention also provides a bicomponent staple fiber comprising poly(ethylene terephthalate) and poly (trimethylene terephthalate) and having a tow crimp development value of about 40% to about 60% and a tow crimp index value of about 14% to about 27%, wherein the difference between the crimp index and the crimp development values is about 24% to about 35% absolute.

The invention also provides a process for making the spun yarn of the invention comprising the steps of:

a) providing a bicomponent staple fiber having a tow crimp development value of about 35% to about 70%, a tow crimp index value of about 14% to about 45%, a length of about 1.3 cm to about 5.5 cm, and a linear density of about 0.7 decitex per fiber to about 3.0 decitex per fiber;

b) providing cotton;

c) combining at least the cotton and the bicomponent staple fiber so that:

the bicomponent fiber is present at a level of about 20 wt % to about 65 wt %, the cotton is present at a level of about 35 wt % to about 80 wt % based on total weight of the blended fibers;

d) carding the blended fibers to form a card sliver;

e) drawing the card sliver;

f) doubling and redrawing the card sliver up to about 3 times;

g) converting the drawn sliver to roving; and h) ring-spinning the roving to form the spun yarn.

In a second embodiment, the invention provides a process for making the spun yarn of the invention comprising the steps of:

a) providing bicomponent staple fiber having a tow crimp development value of about 35% to about 70%, a tow crimp index value of about 14% to about 45%, a length of about 1.3 cm to about 5.5 cm, and a linear density of about 0.7 decitex per fiber to about 3.0 decitex per fiber;

b) providing cotton;

d) separately carding bicomponent staple fiber and cotton to form a bicomponent staple fiber card sliver and a cotton card sliver;

e) draw-frame blending the bicomponent staple fiber card sliver and the cotton card sliver so that (i) the bicomponent fiber is present at a level of from about 20 wt % to about 65 wt %; and (ii) the cotton is present at a level of from about 35 wt % to about 80 wt %, based on total weight of the blended fibers;

f) doubling and redrawing the blended card sliver of step (e) up to about 3 times;

g) converting the drawn sliver to roving; and h) ring-spinning the roving to form the spun yarn.

The invention further provides a fabric selected from the group consisting of knits and wovens and comprising such a spun yarn as made by the process of the invention.

DETAILED DESCRIPTION OF THE INVENTION

Figure 1:
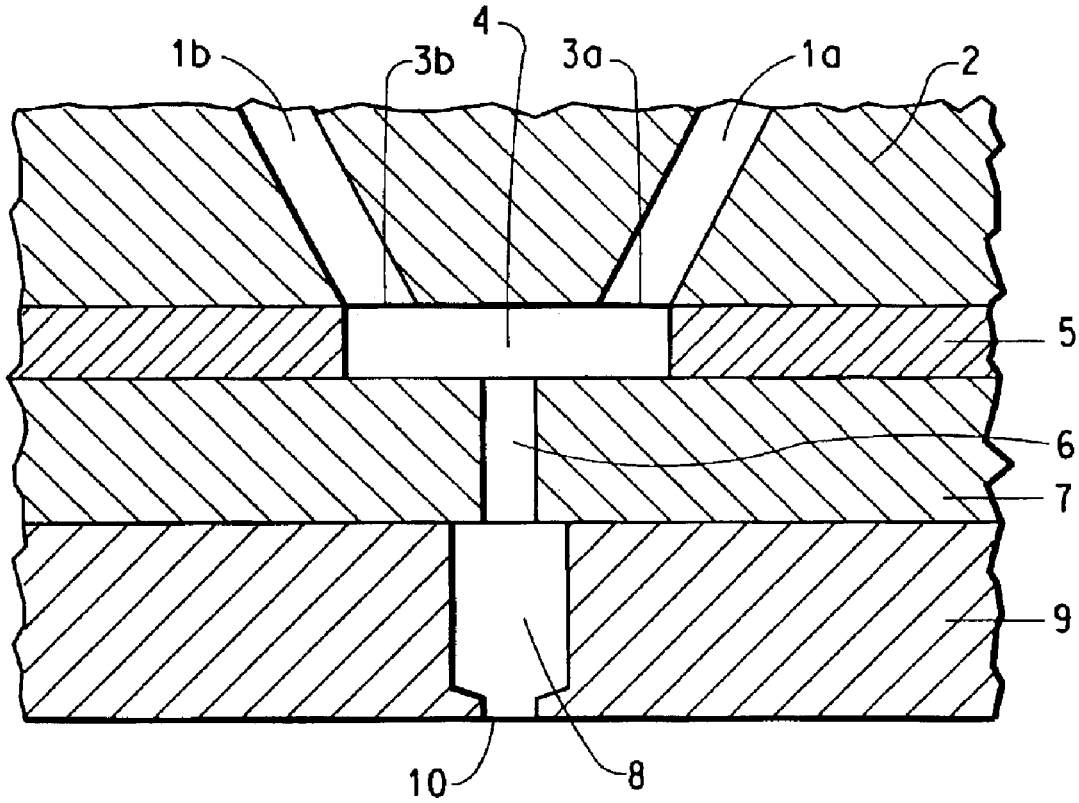
FIG. 1 shows a schematic cross-section of a spinneret pack useful in making bicomponent polyester fiber tow.

It has now been found that spun yarn comprising cotton and a bicomponent staple fiber which in turn comprises poly(ethylene terephthalate) and poly(trimethylene terephthalate) and has selected mechanical properties, has unexpectedly high stretch characteristics, cardability, and uniformity.

It has also now been found that a polyester bicomponent staple fiber can be made with an unexpectedly and advantageously large difference between tow crimp index and tow crimp development values, which difference is manifested in a surprising combination of good processibility as indicated by easy carding and good recovery properties as indicated by high boil-off shrinkage. Such fiber is a preferred bicomponent staple fiber in the cotton/bicomponent spun yarn of the invention.

As used herein, 'bicomponent fiber' means a fiber in which two polymers are in a side-by-side or eccentric sheath-core relationship and includes both spontaneously crimped fibers and fibers with latent spontaneous crimp that has not yet been realized.

"Intimate blending" means the process of gravimetrically and thoroughly mixing dissimilar fibers in an opening room (for example with a weigh-pan hopper feeder) before feeding the mixture to the card or of mixing the fibers in a dual feed chute on the card, and is to be distinguished from draw-frame blending.

"Natural draw ratio" ("NDR") means the upper limit of the yield region on a stress-strain curve of initially undrawn fiber, determined as the intersection of two lines drawn tangent to the yield and strain-hardening regions of the curve, respectively.

The spun yarn of the invention comprises cotton and a polyester bicomponent staple fiber comprising poly (ethylene terephthalate) ("2G-T") and poly(trimethylene terephthalate) ("3G-T") and has a total boil-off shrinkage (sometimes called "boil-off crimp retraction") of at least about 22%. Such shrinkage corresponds to about 20% elongation when a 0.045 g/den (0.04 dN/tex) load is applied to the yarn after boil-off in the yarn. When the total boil-off shrinkage is less than about 22%, the stretch-and-recovery properties of the yarn can be inadequate. The bicomponent staple fiber has a tow crimp development ("CD") value of about 35%, preferably about 40%, to about 70%, preferably to about 60%, and has a crimp index ("CI") value of about 14% to about 45%, preferably to about 27%.

When the CD is lower than about 35%, the spun yarn typically has too little total boil-off shrinkage to generate good recovery in fabrics made therefrom. When the CI value is low, mechanical crimping can be necessary for satisfactory carding and spinning. When the CI value is high, the bicomponent staple can have too much crimp to be readily cardable, and the uniformity of the spun yarn can be inadequate.

The bicomponent staple fiber has a length of about 1.3 cm to about 5.5 cm. When the bicomponent fiber is shorter than about 1.3 cm, it can be difficult to card, and when it is longer than about 5.5 cm, it can be difficult to spin on cotton system equipment. The cotton can have a length of from about 2 to about 4 cm. The bicomponent fiber has a linear density of about 0.7 dtex per fiber, preferably about 0.9 dtex per fiber, to about 3.0 dtex per fiber, preferably to about 2.5 dtex per fiber. When the bicomponent staple has a linear density above about 3.0 dtex per fiber, the yarn can have a harsh hand, and it can be hard to blend with the cotton, resulting in a poorly consolidated, weak yarn. When it has a linear density below about 0.7 dtex per fiber, it can be difficult to card.

In the spun yarn, the bicomponent staple fiber is present at a level of about 20 wt %, preferably about 35 wt %, to about 65 wt %, preferably to less than 50 wt %, based on the total weight of the spun yarn. When the yarn of the invention comprises less than about 20 wt % polyester bicomponent, the yarn can exhibit inadequate stretch and recovery properties, as indicated by low total boil-off shrinkage. When the yarn comprises more than about 65 wt % bicomponent staple fiber, the uniformity of the yarns can be negatively affected.

In the spun yarn of the invention, the cotton is present at a level of about 35 wt % to about 80 wt %, based on total weight of the spun yarn. Optionally, about 1 wt % to about 30 wt %, based on total weight of the spun yarn, can be other staple fibers, for example monocomponent poly(ethylene terephthalate) staple.

When CI is lower in the range of acceptable values, higher proportions of polyester bicomponent staple fibers can be used without compromising cardability and yarn uniformity. When CD is higher in the range of acceptable values, lower proportions of bicomponent staple can be used without compromising total boil-off shrinkage. In particular, since the fiber blend level, CI, and cardability are inter-related, satisfactory cardability can be retained even with high CI values (for example as high as about 45%) if the amount of bicomponent fiber in the blend is low (for example as low as about 20 wt %, based on total weight of spun yarn). Similarly, since the fiber blend level, CD, and total boil-off shrinkage are inter-related, satisfactory total boil-off shrinkage can be retained even at about 20 wt % bicomponent fiber, based on total weight of spun yarn, if the CD is high, for example at about 60% or more.

It is preferred that the spun yarn of the invention have a Coefficient of Variation ("CV") of mass of no higher than about 22%, for example when determined on a spun yarn having a cotton count of 40 or lower, more preferably no higher than about 18%, for example when determined on a spun yarn having a cotton count of 20 or lower. Above those values, the yarn can become less desirable for use in some types of fabrics.

The bicomponent staple fiber can have a weight ratio of poly(ethylene terephthalate) to poly(trimethylene terephthalate) of about 30:70 to 70:30, preferably 40:60 to 60:40. One or both of the polyesters comprising the bicomponent fiber can be copolyesters, and "poly(ethylene terephthalate)" and "poly(trimethylene terephthalate)" include such copolyesters within their meanings. For example, a copoly(ethylene terephthalate) can be used in which the comonomer used to make the copolyester is selected from the group consisting of linear, cyclic, and branched aliphatic dicarboxylic acids having 4–12 carbon atoms (for example butanedioic acid, pentanedioic acid, hexanedioic acid, dodecanedioic acid, and 1,4-cyclohexanedicarboxylic acid); aromatic dicarboxylic acids other than terephthalic acid and having 8–12 carbon atoms (for example isophthalic acid and 2,6-naphthalenedicarboxylic acid); linear, cyclic, and branched aliphatic diols having 3–8 carbon atoms (for example 1,3-propane diol, 1,2-propanediol, 1,4-butanediol, 3-methyl-1,5-pentanediol, 2,2-dimethyl-1,3-propanediol, 2-methyl-1,3-propanediol, and 1,4-cyclohexanediol); and aliphatic and araliphatic ether glycols having 4–10 carbon atoms (for example, hydroquinone bis(2-hydroxyethyl) ether, or a poly(ethyleneether) glycol having a molecular weight below about 460, including diethyleneether glycol). The comonomer can be present to the extent that it does not compromise the benefits of the invention, for example at levels of about 0.5–15 mole percent based on total polymer ingredients. Isophthalic acid, pentanedioic acid, hexanedioic acid, 1,3-propane diol, and 1,4-butanediol are preferred comonomers.

The copolyester(s) can also be made with minor amounts of other comonomers, provided such comonomers do not have an adverse affect on the benefits of the invention. Such other comonomers include 5-sodium-sulfoisophthalate, the sodium salt of 3-(2-sulfoethyl) hexanedioic acid, and dialkyl esters thereof, which can be incorporated at about 0.2–4 mole percent based on total polyester. For improved acid dyeability, the (co)polyester(s) can also be mixed with polymeric secondary amine additives, for example poly(6, 6'-imino-bishexamethylene terephthalamide) and copolyamides thereof with hexamethylenediamine, preferably phosphoric acid and phosphorous acid salts thereof. Small amounts, for example about 1 to 6 milliequivalents per kg of polymer, of tri- or tetra-functional comonomers, for example trimellitic acid (including precursors thereto) or pentaerythritol, can be incorporated for viscosity control.

There is no particular limitation on the outer cross-section of the bicomponent fiber, which can be round, oval, triangular, 'snowman' and the like. A "snowman" cross-section can be described as a side-by-side cross-section having a long axis, a short axis and at least two maxima in the length of the short axis when plotted against the long axis. In one embodiment, the spun yarn of the invention comprises cotton and a bicomponent staple fiber comprising poly(ethylene terephthalate) and poly(trimethylene terephthalate) and having a plurality of longitudinal grooves in the surface thereof. Such a bicomponent staple fiber can be considered to have a "scalloped oval" cross-section which can improve the wicking properties of the polyester bicomponent.

The polyester bicomponent staple fibers in the spun yarn of the present invention can also comprise conventional additives such as antistats, antioxidants, antimicrobials, flameproofing agents, dyestuffs, light stabilizers, and delustrants such as titanium dioxide, provided they do not detract from the benefits of the invention.

The polyester bicomponent staple fiber of the invention has a tow crimp development value of about 40% to about 60% and a crimp index value of about 14% to about 27%, wherein the difference between the crimp index and the crimp development values is about 24% to about 35% absolute, preferably about 30% to about 35% absolute.

It is preferred that the spun yarn of the invention comprise the fiber of the invention and have a tenacity-at-break of at least about 3.5 dN/tex and no higher than about 5.5 dN/tex. When the tenacity is too low, carding and spinning can be difficult, and when it is too high, fabrics made from the spun yarn of the invention can exhibit undesirable pilling. It is also preferred that the linear density of the spun yarn be in the range of about 100 to 700 denier (111 to 778 dtex).

Knit (for example circular knit and flat knit) and woven (for example plainwoven and twill) stretch fabrics can be made from the spun yarn of the invention.

The process to make the spun yarn of the invention comprises a step of mixing, preferably by intimate blending, cotton (which can optionally be combed) with a polyester bicomponent staple fiber having the composition and characteristics described hereinbefore, wherein the bicomponent staple fiber is present at a level of about 20 wt %, preferably about 35 wt %, and to about 65 wt %, preferably to less than 50 wt %, based on the total weight of the blended fibers. The cotton is present at a level of about 35 wt % to about 80 wt %, based on total weight of the blended fibers. Optionally, about 1 wt % to about 30 wt %, based on total weight of the spun yarn, can be other staple fibers, for example monocomponent poly(ethylene terephthalate) staple.

It is unnecessary that the crimps of the bicomponent fibers in the tow precursor to the staple fiber be 'de-registered', that is treated in such a way as to misalign the crimps of the fibers, and it is preferred that no attempt be made to 'de-register' them, in order to save the expense of such an unnecessary step. Similarly, the bicomponent staple tow does not require mechanical crimping in order for staple made therefrom to display good processibility and useful properties, and it is preferred that the tow not be subjected to a mechanical crimping step.

The blended fibers are further processed by carding the blended fibers to form a card sliver, drawing the card sliver, doubling and redrawing the card sliver up to 3 times, converting the drawn sliver to roving, and ring-spinning the roving, preferably with a twist multiplier of about 3 to 5.5, to form the spun yarn having a total boil-off shrinkage of at least about 22%.

Intrinsic viscosity ("IV") of the polyesters was measured with a Viscotek Forced Flow Viscometer Model Y-900 at a 0.4% concentration at 19° C. and according to ASTM D-4603-96 but in 50/50 wt % trifluoroacetic acid/methylene chloride instead of the prescribed 60/40 wt % phenol/1,1,2, 2-tetrachloroethane. The measured viscosity was then correlated with standard viscosities in 60/40 wt % phenol/1,1, 2,2-tetrachloroethane to arrive at the reported intrinsic viscosity values.

Unless otherwise noted, the following methods of measuring tow Crimp Development and tow Crimp Index of the bicomponent fiber were used in the Examples. To measure tow Crimp Index ("C.I."), a 1.1 meter sample of polyester bicomponent tow was weighed, and its denier was calculated; the tow size was typically of about 38,000 to 60,000 denier (42,000 to 66,700 dtex). Two knots separated by 25 mm were tied at each end of the tow. Tension was applied to the vertical sample by applying a first clamp at the inner knot of the first end and hanging a 40 mg/den (0.035 dN/tex) weight between the knots of the second end. The sample was exercised three times by lifting and slowly lowering the weight. Then a second clamp was applied at 100 cm down from the inner knot of the first end while the weight was in place between the knots of the second end, the 0.035 dN/tex weight was removed from the second end, and the sample was inverted while maintaining the tension so that the first end was at the bottom. A 1.5 mg/den (0.0013 dN/tex) weight was hung between the knots at the first end, the first clamp was removed from the first end, the sample was allowed to retract against the 0.0013 dN/tex weight, and the (retracted) length from the clamp to the inner knot at the first end was measured in cm and identified as $L_r$. C.I. was calculated according to Formula I. To measure tow Crimp Development ("C.D."), the same procedure was carried out, except that the 1.1 meter sample was placed—unrestrained—in boiling water for 1 minute and allowed fully to dry before applying the 40 mg/den (0.035 dN/tex) weight.

$$\text{C.I. and C.D. } (\%) = 100 \times (100\text{ cm} - L_r)/100\text{ cm} \quad \text{(I)}$$

Because merely cutting the tow into staple fibers does not affect the crimp, it is intended and is to be understood that references herein to crimp values of staple fibers indicate measurements made on the tow precursors to such fibers.

To determine the total boil-off-shrinkage of the spun yarns in the Examples, the yarn was made into a skein of 25 wraps on a standard skein winder. While the sample was held taut on the winder, a 10 inch (25.4 cm) length ("$L_o$") was marked on the sample with a dye marker. The skein was removed from the winder, placed in boiling water for 1 minute without restraint, removed from the water, and allowed to dry at room temperature. The dry skein was laid flat, and the distance between the dye marks was again measured ("$L_{bo}$"). Total boil-off shrinkage was calculated from formula II:

$$\text{Total B.O.S. } (\%)=100\times(L_o-L_{bo})/L_o \quad \text{(II)}$$

Using the same sample that had been subjected to the boil-off total shrinkage test, the 'true' shrinkage of the spun yarn was measured by applying a 200 mg/den (0.18 dN/tex) load, measuring the extended length, and calculating the percent difference between the before-boil-off and extended after-boil-off lengths. The true shrinkage of the samples was generally less than about 5%. Since true shrinkage constitutes only a very minor fraction of total boil-off shrinkage, the latter is used herein as a reliable measure of the stretch characteristics of the spun yarns. Higher total boil-off shrinkage corresponds to desirably higher stretch.

The uniformity of the mass of the spun yarns along their length was determined with a Uniformity 1-B Tester (made by Zellweger Uster Corp.) and reported as Coefficient of Variation ("CV") in percentage units. In this test, yarn was fed into the Tester at 400 yds/min (366 m/min) for 2.5 minutes, during which the mass of the yarn was measured every 8 mm. The standard deviation of the resulting data was calculated, multiplied by 100, and divided by the average mass of the yarn tested to arrive at percent CV. Data on conventional, commercial yarns can be found in "Uster® Statistics 2001" (Zellweger Luwa AG).

Spun yarn tensile properties were determined using a Tensojet (also made by Zellweger Uster Corp.)

Unless otherwise noted, the cardability of the fiber blends used to make the spun yarns in the Examples was assessed with a Trutzschler Corp. staple card for which a rate of 45 pounds per hour (20 kg/hour) was considered "100% speed". Cardability was rated "Good" if the card could be run at 100% speed with no more than 1 stop in a 40 pound (18 kg) test run, "Satisfactory" for at least 80% speed with no more than 3 stops in a run, and "Poor" if the speed was lower or the number of stops higher than for "Satisfactory". Stops were generally caused by web breaks or coiling jams.

To determine available stretch in the fabrics of Examples 6A and 6B, three 60×6.5 cm sample specimens were cut from each of the fabrics in Examples 4A and 4B. The long dimension corresponded to the stretch direction. Each specimen was unraveled equally on each side until it was 5 cm wide. One end of the fabric was folded to form a loop, and a seam was sewn across the width to fix the loop. At 6.5 cm from the unlooped end of the fabric a first line was drawn, and 50 cm away ("GL") from the first line, a second line was drawn. The sample was conditioned for at least 16 hours at 20+/−2° C. and 65+/−2% relative humidity. The sample was clamped at the first line, and hung vertically. A 30 newton weight was hung from the loop, and the sample was exercised 3 times by alternately allowing it to be stretched by the weight for 3 seconds and then supporting the weight so the fabric was unloaded. The weight was re-applied, and the distance between the lines ("ML") was recorded to the nearest millimeter. The available stretch was calculated from formula III, and the results from the three specimens were averaged $$\%\text{ Available Stretch}=100\times(ML-GL)/GL \quad \text{(III)}$$

To measure percent growth (a measure of recovery after stretching) in Examples 6A and 6B, three new specimens were prepared as described for the Available Stretch test, extended to 80% of the previously determined Available Stretch, and held in the extended condition for 30 minutes. They were then allowed to relax without restraint for 60 minutes, and the length ("$L_2$") between the lines was again measured. Percent Fabric Growth was calculated from Formula IV, and the results from the three specimens were averaged.

$$\%\text{ Fabric Growth}=100\times(L_2-GL)/GL \quad \text{(IV)}$$

In the Examples, the cotton was Standard Strict Low Midland Eastern Variety with an average micronaire of 4.3 (about 1.5 denier per fiber (1.7 dtex per fiber)). The cotton and the polyester bicomponent staple fiber were blended by loading both into a dual feed chute feeder, which fed the Trutzschler card. The resulting card sliver was 70 grain/yard (about 49,500 dtex). Six ends of sliver were drawn together 6.5× in each of two passes to give 60 grain/yard (about 42,500 dtex) drawn sliver which was then converted to roving, unless otherwise noted. The total draft in the roving process was 9.9×. Unless otherwise noted, the roving was then double-creeled and ring-spun on a Saco-Lowell frame using a back draft of 1.35 and a total draft of 29 to give a 22/1 cotton count (270 dtex) spun yarn having a twist multiplier of 3.8 and 17.8 turns per inch. When 100% cotton was so processed, the resulting spun yarn had a CV of 22% and a total boil-off shrinkage of 5%.

Within each bicomponent staple fiber sample, the fibers had substantially equal linear densities and polymer ratios of poly(ethylene terephthalate) to poly(trimethylene terephthalate). No mechanical crimp was applied to the bicomponent staple fibers in the Examples.

In the Tables, "Comp." indicates a Comparison Sample, "NDR" means Natural Draw Ratio, "B.O.S." means boil-off shrinkage, "$Ne_c$" means cotton count (English), and 'nm' indicates 'not measured'.

EXAMPLES

Example 1A

Polyester bicomponent staple fiber was made from bicomponent continuous filaments of poly(ethylene terephthalate) (Crystar® 4415-763, a registered trademark of E. I. du Pont de Nemours and Company), having an intrinsic viscosity ("IV") of 0.52 dl/g, and Sorona® brand poly(trimethylene terephthalate) (Sorona®), a registered trademark of E. I. DuPont de Nemours and Company), having an IV of 1.00, which were melt-spun through a 68-hole post-coalescing spinneret at a spin block temperature of 255–265° C. The weight ratio of the polymers was 60/40 2G-T/3G-T. The filaments were withdrawn from the spinneret at 450–550 m/min and quenched with crossflow air. The filaments, having a 'snowman' cross-section, were drawn 4.4X, heat-treated at 170° C., interlaced, and wound up at 2100–2400 m/min. The filaments had 12% CI (a value believed to be considerably depressed by the interlacing of the continuous filaments), 51% CD, and a linear density of 2.4 dtex/filament. For conversion to staple fiber, filaments from wound packages were collected into a tow and fed into a conventional staple tow cutter, the blade spacings of which were adjusted to obtain a 1.5 inch (3.8 cm) staple length.

Example 1B

The polyester bicomponent staple fiber from Example 1A was intimately blended with cotton to obtain various weight percents of the two fibers. The blended fibers were carded, drawn, converted to roving, and ring-spun into a 22/1 yarn. The resulting spun yarns had the CV and total Boil-Off Shrinkage values shown in Table I.

TABLE I

| Spun Yarn | Staple Bicomponent, wt % | Cardability | Yarn_CV, % | Yarn Total B.O.S., % |
|---|---|---|---|---|
| Comp. Sample 1A | 30 | Good | 17 | 18 |
| Sample 1B | 40 | Good | 18 | 24 |
| Sample 1C | 50 | Satisfactory | 19 | 34 |
| Sample 1D | 60 | Satisfactory | 22 | 36 |
| Comp. Sample 1E | 70 | Poor | 25 | nm |

Interpolation of the data in Table I shows that total boil-off shrinkage was low when this particular bicomponent staple was less than about 35 wt % of the weight of the spun yarn. The data also show that cardability suffered when the amount of polyester bicomponent staple fiber exceeded about 65 wt %, based on weight of the spun yarn. Uniformity was improved if the proportion of polyester bicomponent was less than 50 wt %.

Comparison Example 1

Polyester bicomponent staple fiber was made as described in Example 1A, with the following differences. The weight ratio of 2G-T/3G-T was 40/60, the spinneret had 34 holes, and the resulting filaments had a 4.9 dtex/fil linear density. The CI was 16% and the CD was 50%, but cardability with cotton at levels of 65 wt %, 40 wt %, and even 20 wt % polyester bicomponent staple was very poor, showing the unsatisfactory results obtained when the polyester bicomponent staple had high linear density.

Comparison Example 2

Polyester bicomponent staple fiber was made substantially as described in Example 1A, except that the continuous filaments used were drawn 2.6X and had only 3% CI and 29% CD. Cardability was good in a 60/40 polyester/cotton blend, but the boil-off shrinkage of the yarn spun from such a blend was only 15%, showing the inadequate spun yarn properties that result when CD is too low.

Example 2

To make the polyester bicomponent staple fibers used in Examples 3 and 4, poly(ethylene terephthalate) of 0.58 IV was prepared in a continuous polymerizer from terephthalic acid and ethylene glycol in a two-step process using an antimony transesterification catalyst in the second step. $TiO_2$ (0.3 wt %, based on weight of polymer) was added, and the polymer was transferred at 285° C. and fed by a metering pump to a 790-hole bicomponent fiber spinneret pack maintained at 280° C. Poly(trimethylene terephthalate) (1.00 IV Sorona® brand poly(trimethylene terephthalate)) was dried, melt-extruded at 258° C., and separately metered to the spinneret pack.

The figure shows a cross-section of the spinneret pack that was used. Molten poly(ethylene terephthalate) and poly (trimethylene terephthalate) entered distribution plate 2 at holes 1*a* and 1*b*, were distributed radially through corresponding annular channels 3*a* and 3*b*, and first contacted each other in slot 4 in distribution plate 5. The two polyesters passed through hole 6 in metering plate 7 and through counterbore 8 in spinneret plate 9, and exited the spinneret plate through capillary 10. The internal diameters of hole 6 and capillary 10 were substantially the same.

The fibers were spun at 0.5–1.0 g/min per capillary into a radial flow of air supplied at 142 to 200 standard cubic feet per minute (4.0 to 5.6 cubic meters per minute) so that the mass ratio of air:polymer was in the range of 9:1 to 13:1. The quench chamber was substantially the same as that disclosed in U.S. Pat. No. 5,219,506 but used a foraminous quench gas distribution cylinder having similar sized perforations so that it provided 'constant' air flow. Spin finish was applied to the fibers with a conical applicator at 0.07 wt % to 0.09 wt % based on fiber weight, and then they were wound onto packages.

About 48 packages of the resulting side-by-side, round cross-section fibers were combined to make a tow of about 130,000 denier (144,400 dtex), passed around a feed roll to a first draw roll operated at less than 35° C., passed to a second draw roll operated at 85° C. to 90° C. and supplied with a hot water spray, heat-treated by contact with six rolls operated at 170° C., optionally over-fed by up to 14% to a puller roll, and, after application of 0.14 wt % finish based on weight of fiber, passed through a continuous, forced convection dryer operating at below 35° C. The tow was then collected into boxes under substantially no tension. The first draw was 77–90% of the total draw applied to the fibers. The drawn tow was about 37,000 denier (41,200 dtex) to 65,000 denier (72,200 dtex), depending on the draw ratio. Additional spinning and drawing conditions and fiber properties are given in Table II.

TABLE II

| Tow Sample* | Spinning Speed, m/min | Drawing: Roll Speeds, m/min Feed | Draw 1 | Draw 2 | Puller | Total Draw Ratio | Over-Feed %** | Linear Density, dtex/fiber | Tenacity dN/tex |
|---|---|---|---|---|---|---|---|---|---|
| Sample 2A | 1800 | 17.4 | 41.1 | 45.7 | 43.4 | 2.6 | 5 | 2.2 | 4.1 |
| Sample 2B | 1700 | 22.9 | 41.1 | 45.7 | 43.9 | 2.0 | 4 | 1.8 | nm |
| Sample 2C | 1500 | 20.9 | 56.5 | 73.2 | 64.3 | 3.5 | 14 | 1.2 | 5.0 |
| Comp. Sample 2D | 1500 | 21.3 | 56.5 | 73.2 | 68 | 3.4 | 8 | 1.3 | nm |
| Sample 2E | 1500 | 19.7 | 41.1 | 45.7 | 45.7 | 2.3 | 0 | 1.6 | 3.6 |
| Sample 2F | 1500 | 26.1 | 58.1 | 73.2 | 64 | 2.8 | 14 | 1.4 | 4.1 |
| Sample 2G | 1500 | 26.1 | 58.1 | 73.2 | 67.7 | 2.8 | 8 | 1.4 | nm |
| Sample 2H | 1500 | 17.4 | 41.1 | 45.7 | 41.4 | 2.6 | 10 | 1.4 | 4.3 |
| Sample 2I | 1600 | 21.7 | 57.1 | 73.1 | 64.2 | 3.4 | 14 | 1.0 | 4.8 |
| Comp. Sample 2J | 1600 | 23.3 | 41.1 | 45.7 | 44.3 | 2.0 | 3 | 1.6 | 2.7 |

*Sample 2A had a 70/30 2G-T/3G-T weight ratio; all others were 60/40 2G-T/3G-T.
**(Draw Roll 2 speed - Puller Roll speed)/(Puller Roll speed)

Example 3

Selected tow samples made in Example 2 were cut to 1.5 inches (3.8 cm), and the resulting bicomponent staple samples were intimately blended with cotton, carded, and ring spun at a 60/40 polyester/cotton weight ratio to make 22/1 cotton count spun yarns. Fiber properties, cardability when blended with cotton, and properties of the resulting spun yarns are given in Table III.

TABLE III

| Bicomponent Staple From: | Tow C.I. % | Cardability | Tow C.D. % | Spun Yarn Sample | Yarn B.O.S. % | Yarn CV, % |
|---|---|---|---|---|---|---|
| Comp. Sample 2J | 9 | Good | 26 | Comp. Sample 3A | 20 | 15 |
| Sample 2B | 16 | Good | 35 | Sample 3B | 24 | 19 |
| Sample 2A | 28 | Satisfactory | 49 | Sample 3C | 34 | 20 |
| Sample 2H | 34 | Satisfactory | 53 | Sample 3D | 39 | 19 |
| Sample 2E | 36 | Satisfactory | 53 | Sample 3E | 38 | 22 |

Interpolation and extrapolation of the data in Table III show that when CI is below about 14%, boil-off shrinkage can be inadequate, and that when CI is as high as about 42%, cardability can remain satisfactory.

Comparison Example 3

Bicomponent staple cut to 3.8 cm from tow Sample 2B was blended with cotton at a polyester bicomponent/cotton weight ratio of 60/40, and the blend was carded and drawn as described hereinabove, but without making a roving. The drawn sliver was air-jet spun into 22/1 yarn on a Murata 802H spinning frame at an air nozzle pressure ratio (N1/N2) of 2.5/5.0, a total draft of 160, and a take-up speed of 200 meters/min. The total boil-off shrinkage of the yarn was only 14%, showing that air-jet spun yarn had unsatisfactory stretch and recovery.

Example 4

Selected tow samples made in Example 2 were cut to 1.5 inches (3.8 cm), and the resulting bicomponent staple samples were intimately blended with cotton, carded, and ring-spun at 60/40 and 40/60 polyester/cotton weight ratios to make 22/1 cotton count spun yarns. Fiber properties, cardability of the fiber blends, and properties of the resulting spun yarns are given in Table IV.

TABLE IV

| Bicomponent Staple From: | Bicomponent staple, wt % | Tow C.I., % | Cardability | Tow C.D., % | Spun Yarn | Yarn B.O.S., % | Yarn CV, % |
|---|---|---|---|---|---|---|---|
| Sample 2I | 60 | 24 | Satisfactory | 48 | Sample 4A | 28 | 18 |
| Sample 2C | 60 | 34 | Satisfactory | 56 | Sample 4B | 37 | 19 |
| Sample 2F | 60 | 28 | Satisfactory | 49 | Sample 4C | 31 | 20 |
| Comp. Sample 2D | 60 | 47 | Poor | 57 | Comp. Sample 4D | 38 | 25 |
| Sample 2G | 60 | 44 | Poor | 54 | Comp. Sample 4E | 28 | 22 |
| Sample 2F | 40 | 28 | Good | 49 | Sample 4F | 24 | 18 |
| Sample 2G | 40 | 44 | Satisfactory | 54 | Sample 4G | 25 | 22 |

The data in Table IV show that, when CI is above about 42%, carding can be impractically difficult at 60 wt % bicomponent staple but satisfactory at 40 wt % bicomponent staple. Extrapolation of the data shows that at about 20 wt % bicomponent staple having CI as high as about 45%, carding would be good and total boil-off shrinkage and yarn uniformity (CV) would still be acceptable.

Example 5

Women's 3×1 quarter socks with a ½ cushion foot were knit on a ing only spun yarns from Example 1. Each sock was bleached with aqueous hydrogen peroxide at 180° F. (82° C.) and boarded at 250° F. (121° C.) for 1.5 minutes with dry heat.

The unload power of the socks was determined as follows. To avoid edge effects, the sock was not cut. It was marked with a 2.5 inch×2.5 inch (6.4 cm×6.4 cm) square, centered on the foot, between the toe and heel. The grips of an Instron tensile tester were placed at the sock foot top and bottom, avoiding the heel and toe and leaving the centered square between the grips so that the test sample had a 2.5 inch (6.4 cm) gauge. Each sample was cycled 3 times to 50% elongation at a speed of 200% elongation per minute. The unload force was measured at 30% remaining available stretch on the $3^{rd}$ cycle relaxation and reported in kilograms force and is reported in Table V. In this test, "30% remaining available stretch" means that the fabric had been relaxed 30% from the maximum force on the $3^{rd}$ cycle.

TABLE V

| Knit Sample | Spun Yarn | Sock Fabric Weight, g/m^2 | Bicomponent Content, wt % | Unload Force (kg) |
|---|---|---|---|---|
| 5A | Sample 1D | 180 | 60 | 0.10 |
| 5B | Sample 1C | 177 | 50 | 0.09 |
| 5C | Sample 1B | 165 | 40 | 0.08 |
| Comp. 5E | None | 127 | 0 | 0.04 |

The data in Table V show that knit fabric comprising spun yarn of the invention has high fabric unload force and good stretch-and-recovery properties which are retained even in knits made with spun yarns comprising lower levels of the polyester bicomponent staple fiber.

Example 6A

A 3/1 twill fabric was made on an air jet loom with a warp of 100% ring-spun cotton of 40/1 cotton count, reeded to 96 ends/inch (38 ends/cm). The filling yarn consisted of a 22/1 cotton count ring-spun yarn of 40 wt % cotton and 60 wt % of bicomponent staple cut to 3.8 cm from tow Sample 2H, inserted at 65 picks per inch (25½ picks per cm) and 500 picks/minute. The fabric was scoured for an hour at the boil and conventionally dyed with direct and disperse dyes. The available stretch was 21%, and the growth was 3.8%, both desirable properties.

Example 6B

Example 6A was repeated but with a spun yarn of bicomponent staple cut to 3.8 cm from tow Sample 2E, ring-spun at the same blend ratio with cotton, inserted at 45 picks per inch (18 picks/cm). The fabric was scoured for hour at the boil and conventionally dyed with direct and disperse dyes. The available stretch was desirably high at 25%, and the growth was desirably low at 4.6%.

Example 7A

To make tow Samples 7A through 7E, unless otherwise noted, poly(trimethylene terephthalate) (Sorona® 1.00 IV) was extruded at a maximum temperature of about 260° C. and poly(ethylene terephthalate) ('conventional', semi-dull, Fiber Grade 211 from Intercontinental Polymers, Inc., 0.54 dl/g IV) was extruded at a maximum temperature of 285° C., and the two polymers were separately metered to a spinneret pack like that of FIG. 1 except that metering plate 7 was absent. The spinneret pack was heated to 280° C. and had 2622 capillaries. In the resulting side-by-side round cross-section fibers, the 2G-T was present at 52 wt %, and the 3G-T was present at 48 wt % and had an IV of 0.94 dl/g. Fibers were collected from multiple spinning positions by puller rolls operating at 1200–1500 m/min and piddled into cans.

Figure 2:
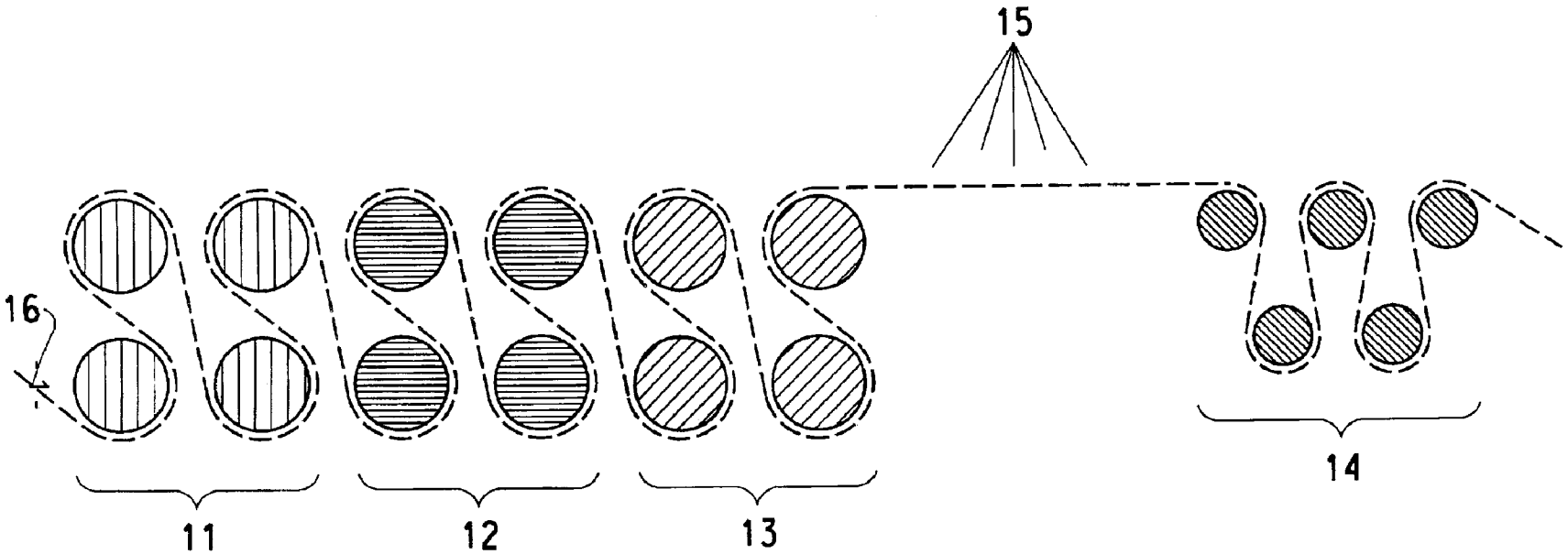
FIG. 2 shows schematically a roll configuration that can be used in making a tow precursor to the staple bicomponent fiber of the invention.

Tow from about 50 cans was combined, passed around a feed roll to a first draw roll operated at less than 35° C., through a steam chest operated at 80° C., and then to a second draw roll. The first draw was about 80% of the total draw applied to the fibers. The drawn tow was about 800,000 denier (888,900 dtex) to 1,000,000 denier (1,111,100 dtex). Referring to FIG. 2, drawn tow 16 was heat-treated by contact with rolls 11 operated at 110° C., by rolls 12 at 140°–160° C., and by rolls 13 at 170° C. The ratio of roll speeds between rolls 11 and 12 was about 0.91 to 0.99 (relaxation), between rolls 12 and 13 it was about 0.93 to 0.99 (relaxation), and between rolls 13 and 14 it was about 0.88 to 1.03. Finish spray 15 was applied so that the amount of finish on the tow was 0.15 to 0.35 wt %. Puller/cooler rolls 14 were operated at 35–40° C. The tow was then passed through a continuous, forced convection dryer operating at below 35° C. and collected into boxes under substantially no tension. Additional processing conditions and fiber properties are given in Table VI.

TABLE VI

| Sample | NDR | Total Draw Ratio | Average dTex/fiber | Tow Cl, % | Tow CD, % | CD-Cl, % |
|---|---|---|---|---|---|---|
| 7A | 1.90 | 2.92 | nm | 14 | 47 | 34 |
| 7B | 1.90 | 3.08 | nm | 24 | 54 | 30 |
| 7C | 1.90 | 2.93 | 1.7 | 14 | 43 | 30 |
| 7D (1) | 1.95 | 2.99 | 1.6 | 27 | 54 | 28 |
| 2I | 1.87 | 3.37 | 1.0 | 24 | 48 | 24 |
| 7E (Comp.) | 1.90 | 2.93 | nm | 7 | 29 | 22 |

(1) Used 0.55 dlg/IV Crystal ® 4415 poly(ethylene terephthalate) to which was added 500 ppm trimethyltrimetallitate; about ½ of holes 6 in metering plate 7 (see FIG. 1) were absent; the IV of the poly(trimethylene terephthalate) in the fibre was 0.88 dl/g; rolls 13 were operated at 175° C.

Example 7B

Tow Samples 7B, 7C, and 7E were cut to 1.75 inch (4.4 cm) staple, combined with cotton by intimate blending, carded on a J. D. Hollingsworth card at 60 pounds (27 kg) per hour, and ring-spun to make yarns of various cotton counts. The yarns and their properties are described in Table VII; cardability was estimated on a qualitative basis.

TABLE VII

| | | Spun Yarn | Bicomponent Staple | | | |
|---|---|---|---|---|---|---|
| Spun Yarn Sample | Cardability | Cotton Count ($Ne_c$) | From Tow Sample No. | Content in Yarn, wt % | Yarn CV, % | Yarn B.O.S. % |
| 7F | Satisfactory | 40 | 7B | 40 | 21.4 | 25% |
| 7G | Good | 40 | 7C | 40 | 22.4 | 25% |
| 7H (Comp.) | Good | 40 | 7E (Comp.) | 40 | 21.1 | 20% |
| 7F | Satisfactory | 12 | 7B | 60 | 15.2 | 31% |
| 7G | Good | 12 | 7C | 60 | 15.8 | 30% |
| 7H (Comp.) | Good | 12 | 7E (Comp.) | 60 | 14.1 | 26% |
| 7F | Satisfactory | 20 | 7B | 60 | 17.1 | 34% |
| 7G | Good | 20 | 7C | 60 | 16.3 | 31% |
| 7H (Comp.) | Good | 20 | 7E (Comp.) | 60 | 15.4 | 28% |

The data in Table VII show improved boil-off shrinkage of the yarns of the invention and their unexpectedly consistent CV in spite of increasing CI.

The yarns produced in the examples and fabrics made therefrom in accordance with the invention were soft and aesthetically pleasing.

What is claimed is:

1. A spun yarn having a total boil-off shrinkage of at least about 22% comprising cotton and a bicomponent staple fiber comprising poly(ethylene terephthalate) and poly (trimethylene terephthalate) said bicomponent staple fiber having:

a) a tow crimp development value of about 35% to about 70%;

b) a tow crimp index value of about 14% to about 45%;

c) a length of about 1.3 cm to about 5.5 cm; and d) a linear density of about 0.7 decitex per fiber to about 3.0 decitex per fiber;

e) the difference between the crimp index and the crimp development values is about 24% to about 35% absolute;

wherein the bicomponent staple fiber is present at a level of about 20 wt %, to about 65 wt %, based on total weight of the spun yarn; and wherein the cotton is present at a level of about 35 wt % to about 80 wt %, based on total weight of the spun yarn.

2. The spun yarn of claim 1 having a coefficient of variation of mass no higher than about 22% and wherein the bicomponent staple fiber is present at a level of about 20 wt % to less than 50 wt %, based on the total weight of spun yarn.

3. The spun yarn of claim 1 further comprising about 1 wt % to 30 wt % poly(trimethylene terephthalate) monocomponent staple fiber.

4. A bicomponent staple fiber comprising poly(ethylene terephthalate) and poly(trimethylene terephthalate) and having a tow crimp development value of about 40% to about 60% and a tow crimp index value of about 14% to about 27%, wherein the difference between the crimp index and the crimp development values is about 24% to about 35% absolute.

5. The spun yarn of claim 1 comprising the bicomponent staple fiber of claim 4.

6. The bicomponent staple fiber of claim 4 wherein the difference between the crimp index and the crimp development values is about 30% to about 35% absolute.

7. A fabric selected from the group consisting of knits and wovens and comprising the spun yarn of claim 1.

* * * * *

UNITED STATES PATENT AND TRADEMARK OFFICE

CERTIFICATE OF CORRECTION

PATENT NO. : 7,036,299 B2
APPLICATION NO. : 10/323302
DATED : May 2, 2006
INVENTOR(S) : Geoffrey D. Hietpas et al.

It is certified that error appears in the above-identified patent and that said Letters Patent is hereby corrected as shown below:

At Column 12, line 28, delete "ing" and replace it with
-- Lonati 454J, 108 needle, 4 inch (10 cm) cylinder machine using --

Signed and Sealed this

Sixth Day of February, 2007

JON W. DUDAS
*Director of the United States Patent and Trademark Office*